United States Patent [19]

Tanaka et al.

[11] 4,149,886

[45] Apr. 17, 1979

[54] LIGHT-SENSITIVE MATERIAL WITH COUPLER CONTAINING TRIAZOLE COUPLING-OFF GROUP

[75] Inventors: Mitsugu Tanaka; Morio Yagihara; Toshiaki Aono; Takeshi Hirose, all of Minami-ashigara, Japan

[73] Assignee: Fuji Photo Film Co., Ltd., Minami-ashigara, Japan

[21] Appl. No.: 748,857

[22] Filed: Dec. 9, 1976

[30] Foreign Application Priority Data

Dec. 9, 1975 [JP] Japan ..... 50-146570

[51] Int. Cl.[2] ..... G03C 7/00; G03C 1/40; G03C 5/30

[52] U.S. Cl. ..... 96/56.5; 96/66.3; 96/74; 96/100 N

[58] Field of Search ..... 96/100, 55, 56.5, 56.2, 96/56.3, 56.4, 56.6, 74, 95, 66.3, 109

[56] References Cited

U.S. PATENT DOCUMENTS

| | | | |
|---|---|---|---|
| 2,186,735 | 1/1940 | Schneider et al. | 96/100 |
| 3,933,500 | 1/1976 | Shiba et al. | 96/100 |

FOREIGN PATENT DOCUMENTS 1204680 9/1970 United Kingdom.

*Primary Examiner*—Richard L. Schilling
*Attorney, Agent, or Firm*—Sughrue, Rothwell, Mion, Zinn and Macpeak

[57] ABSTRACT

A photographic light-sensitive material comprising a support having thereon at least one silver halide emulsion layer containing a development inhibitor releasing photographic coupler represented by the following general formula (I):

(I)

wherein $R_1$, $R_2$, $R_3$ and $R_4$, which can be the same or different, each represents a hydrogen atom, an aliphatic residue, an aromatic residue or a heterocyclic residue; and X represents a triazole ring which is released upon reaction of the coupler with an oxidation product of an aromatic primary amine developing agent and which exhibits development inhibiting effects; wherein the triazole ring is connected to the coupling position of the coupler through the nitrogen atom at the 1-position of the triazole ring.

30 Claims, No Drawings

LIGHT-SENSITIVE MATERIAL WITH COUPLER CONTAINING TRIAZOLE COUPLING-OFF GROUP

BACKGROUND OF THE INVENTION

1. FIELD OF THE INVENTION

The present invention relates to a photographic light-sensitive material containing a novel coupler and more particularly, it relates to a photographic light-sensitive material containing a novel DIR coupler (Development Inhibitor Releasing Coupler) which is capable of releasing a development inhibitor upon reaction with an oxidation product of a developing agent.

2. DESCRIPTION OF THE PRIOR ART

Incorporation of a compound which releases a development inhibitor upon development depending on the density of an image into a photographic light-sensitive material is conventional. Such a compound generally reacts with an oxidation product of a color developing agent and releases a development inhibitor. As a typical example, the so-called DIR coupler in which a group capable of exhibiting development inhibiting effects upon release from the active position is introduced in the active position thereof is known. The DIR coupler not only forms a dye but also releases a development inhibitor upon coupling with an oxidation product of a color developing agent. The compounds described in U.S. Pat. Nos. 3,227,554, 3,701,783, 3,615,506, 3,617,291, etc., and further the improved compounds thereof such as the couplers in which a triazole ring or a diazole ring is bonded to the coupling position through the nitrogen atom at the 1-position in the triazole or diazole ring as described in Japanese Patent Application (OPI) No. 122335/1974 are known as DIR couplers.

As is well known from the above-described patent specifications and the like, a DIR coupler is used for controlling the image tone, reducing the graininess of the image, improving the sharpness of the image due to edge effects, improving color reproduction due to inter-image effects, and the like.

Although the photographic properties are greatly improved with the invention of Japanese Patent Application (OPI) No. 122335/1974, it is desirable to still further improve these photographic properties.

SUMMARY OF THE INVENTION

Investigations to develop novel DIR couplers have been made and it has now been found that a coupler which has a malonamide skeleton and a triazole ring having development inhibiting effects which is connected to the coupling position of the coupler through the nitrogen atom at the 1-position in the triazole ring exhibits exceptionally superior properties.

Therefore, a first object of the present invention is to provide a photographic light-sensitive material containing a novel DIR coupler.

A second object of the present invention is to provide a photographic light-sensitive material containing a DIR coupler which reacts rapidly with an oxidation product of a developing agent to release a compound having developemnt inhibiting effects.

A third object of the present invention is to provide a photographic light-sensitive material containing a DIR coupler with which sufficient control of the image tone, sufficient reduction in the graininess of the image, sufficient improvement of the sharpness of the image and improvement of color reproduction can all be achieved.

A fourth object of the present invention is to provide a silver halide photographic light-sensitive material containing a novel DIR coupler.

A fifth object of the present invention is to provide a photographic processing solution containing a novel DIR coupler.

A sixth object of the present invention is to provide a method of forming images by conducting development processing in the presence of a novel DIR coupler.

These objects of the present invention are effectively achieved in one embodiment with a photographic light-sensitive material comprising a support having thereon at least one silver halide emulsion layer containing a DIR coupler capable of releasing a development inhibitor upon the reaction with an oxidation product of a color developing agent represented by the following general formula (I):

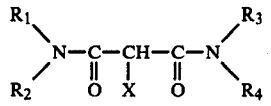

(I)

wherein $R_1$, $R_2$, $R_3$ and $R_4$, which can be the same or different, each represents a hydrogen atom, an aliphatic residue, an aromatic residue or a heterocyclic residue and X represents a triazole ring which is released upon reaction of the coupler with an oxidation product of an aromatic primary amine developing agent and exhibits development inhibiting effects and the triazole ring is connected to the coupling position of the coupler through the nitrogen atom at the 1-position in the triazole ring.

In another embodiment of this invention, the present invention provides a photographic developing solution containing the DIR coupler having the general formula (I) described above.

In an even further embodiment of this invention, this invention provides a method of forming images, comprising developing an imagewise exposed photographic light-sensitive material comprising a support having thereon at least one silver halide emulsion layer in the presence of a DIR coupler represented by the general formula (I) described above.

DETAILED DESCRIPTION OF THE INVENTION

The photographic coupler according to the present invention is characterized by having a malonamide skeleton and triazole ring connected to the active methylene group (coupling position) thereof through the nitrogen atom at the 1-position in the triazole ring.

In more detail, the aliphatic residue represented by $R_1$, $R_2$, $R_3$ and $R_4$ in the above-described general formula (I) preferably contains 1 to 25 carbon atoms and can be unsaturated, branched or cyclic. The aliphatic residue can be substituted with one or more substituents, or example, an alkoxy group (preferably having 1 to 15 carbon atoms, such as methoxy, isopropoxy, etc.), a halogen atom (such as chlorine, bromine, etc.), a hydroxy group, a carboxy group, a sulfo group, a heterocyclic group (preferably derived from a 5- or 6-membered ring containing one or more of a nitrogen atom, an oxygen atom or a sulfur atom as a hetero atom, such as tetrahydrofuryl, pyridyl, etc.), an aryl group (preferably having 6 to 10 carbon atoms, such as phenyl, tolyl, etc.), and the like. Preferred examples of aliphatic residues are, for example, methyl, ethyl, isopropyl, tetradecyl, octadecyl, etc.

The aromatic residue represented by $R_1$, $R_2$, $R_3$ and $R_4$ preferably contains 6 to 35 total carbon atoms and includes both a substituted phenyl group and an unsubstituted phenyl group. Suitable substituents which can be present include one or more of a monovalent substituent, for example, a halogen atom (such as fluorine, chlorine, bromine, etc.), a nitro group, a cyano group, a thiocyano group, a hydroxy group, an alkoxy group (preferably having 1 to 15 carbon atoms, such as methoxy, isopropoxy, octoxy, etc.), an aryloxy group (such as phenoxy, nitrophenoxy, etc.), an alkyl group (preferably having 1 to 15 carbon atoms, such as methyl, ethyl, dodecyl, etc.), an alkenyl group (preferably having 1 to 15 carbon atoms, such as allyl, etc.), an aryl group (preferably having 6 to 10 carbon atoms, such as phenyl, tolyl, etc.), an amino group (e.g., an unsubstituted amino group or an alkylamino group having 1 to 15 carbon atoms such as diethylamino, octylamino, etc.), a carboxy group, an acyl group (preferably having 2 to 16 carbon atoms, such as acetyl, decanoyl, etc.), an alkoxycarbonyl group (preferably having an alkyl moiety of 1 to 20 carbon atoms, such as methoxycarbonyl, butoxycarbonyl, octoxycarbonyl, dodecyloxycarbonyl, 2-phenylethyloxycarbonyl, 2-methoxyethoxycarbonyl, etc.), an aryloxycarbonyl group (preferably having an aryl moiety of 6 to 20 carbon atoms, such as phenoxycarbonyl, tolyloxycarbonyl, etc.), a carbamoyl group (such as ethylcarbamoyl, octylcarbamoyl, etc.), an acylamino group (preferably having 2 to 21 carbon atoms, such as acetamido, octanamido, 2,4-di-tert-pentylphenoxyacetamido, etc.), a sulfo group, an alkylsulfonyl group (preferably having 1 to 15 carbon atoms, such as methylsulfonyl, octylsulfonyl, etc.), an arylsulfonyl group (preferably having 6 to 20 carbon atoms, such as phenylsulfonyl, octoxyphenylsulfonyl, etc.), an alkoxysulfonyl group (preferably having 1 to 15 carbon atoms, such as methoxysulfonyl, octoxysulfonyl, etc.), an aryloxysulfonyl group (preferably having 6 to 20 carbon atoms, such as phenoxysulfonyl, etc.), a sulfamoyl group (preferably having 1 to 15 carbon atoms, such as diethylsulfamoyl, octylsulfamoyl, methyloctadecylsulfamoyl, etc.), a sulfonamino group (preferably having 1 to 15 carbon atoms, such as methylsulfonamino, octylsulfonamino, etc.), and the like or a divalent substituent which forms a fused ring (such as a naphthalene ring, etc.) together with the phenyl group.

The heterocyclic residue represented by $R_1$, $R_2$, $R_3$ and $R_4$ preferably contains 1 to 25 carbon atoms. Preferred heterocyclic residues are derived from a 5-membered or 6-membered ring containing one or more of a nitrogen atom, an oxygen atom, or a sulfur atom as a hetero atom. The heterocyclic residue can be substituted with one or more substituents, for example, an alkyl group (preferably having 1 to 15 carbon atoms, such as methyl, isopropyl, octyl, etc.), an alkoxy group (preferably having 1 to 15 carbon atoms, such as methoxy, isopropoxy, octoxy, etc.), a halogen atom (such as chlorine, bromine, etc.), an alkoxycarbonyl group (preferably having 1 to 20 carbon atoms, such as methoxycarbonyl, ethoxycarbonyl, octoxycarbonyl, etc.), and the like. Preferred examples of the heterocyclic residues are 3-pyridyl, 4-pyridyl, etc.

Examples of triazole ring groups represented by X include (a) a benzotriazole group which can be substituted with one or more substituents, for example, an alkyl group (preferably having 1 to 10 carbon atoms, such as methyl, butyl, etc.), an alkoxy group (preferably having 1 to 15 carbon atoms, such as methoxy, octoxy, etc.), a halogen atom (such as chlorine, bromine, etc.), an alkylamido group (preferably having 1 to 15 carbon atoms, such as acetamido, octanamido, etc.), an aralkoxy group (preferably having 7 to 8 total carbon atoms, such as benzyloxy, etc.) (for example, 5- or 6-methylbenzotriazolyl, 5- or 6-bromobenzotriazolyl, 5- or 6-octanamidobenzotriazolyl, 5- or 6-benzyloxybenzotriazolyl); (b) a benzotriazolyl group having on the benzene ring, a thiazolinylidene group represented by the general formula (II):

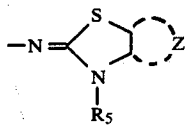

(II)

wherein Z represents the atoms necessary to form a fused aromatic ring, for example, a benzene ring, etc., and the ring can contain one or more substituents, for example, an alkyl group (such as methyl, ethyl, propyl, etc.), an alkoxy group (such as methoxy, ethoxy, etc.), a halogen atom (such as chlorine, bromine, etc.), and the like; $R_5$ represents an aliphatic group (for example, an alkyl group having 1 to 4 carbon atoms, an alkyl group substituted with one or more substituents, such as an alkoxy group, a halogen atom, an aryl group, etc., or an aryl group) (for example, 5- or 6-(3-methylbenzothiazolinyliden)aminobenzotriazolyl, 5- or 6-(3-ethylbenzothiazolinyliden)aminobenzotriazolyl, 5- or 6-(3-benzylbenzothiazolinyliden)aminobenzotriazolyl, etc.); (c) a quinoxalino[2,3-f]benzotriazolyl group; and (d) a 1,2,4-triazolyl group which can be substituted with the above-described thiazolinylidene group of the general formula (II) (such as ω-di(3-methylbenzothiazolinyliden)amino group, etc.), an alkyl group (preferably having 1 to 10 carbon atoms, such as methyl, butyl, etc.), or an alkylamido group (preferably containing 1 to 15 carbon atoms in the alkyl moiety thereof, such as acetamido, octamido, etc.) (for example, 3,5-di(3-methylbenzothiazolinyliden)amino-1,2,4-triazolyl, 3,5-di-octadecanamido-1,2,4-triazolyl, and the like).

The benzotriazole ring substituted with the thiazolinylidene group represented by the general formula (II) is preferred in view of the exceptionally high activity achieved. For reference, the case wherein the triazole ring is bonded through the nitrogen atom at the 1-position and the case wherein the triazole ring is bonded through the nitrogen atom at the 2-position are clearly different in their chemical structures as illustrated below.

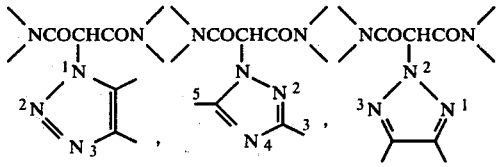

Of the photographic couplers represented by the general formula (I), those photographic couplers wherein $R_1$ and $R_3$ each represents a hydrogen atom and $R_2$ and $R_4$ each represents an aromatic residue as defined above are preferred.
Typical examples of the DIR couplers represented by the general formula (I) are shown in the following.
(1)
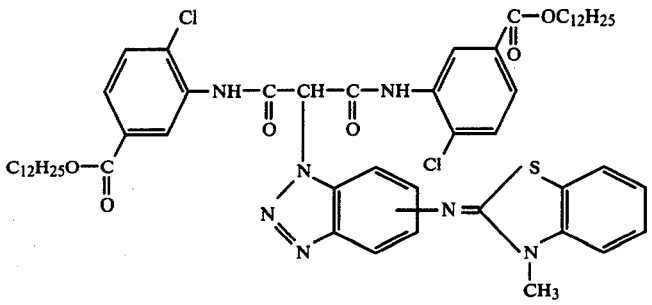
(2)
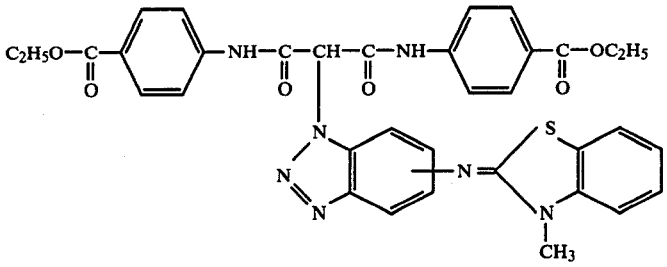
(3)
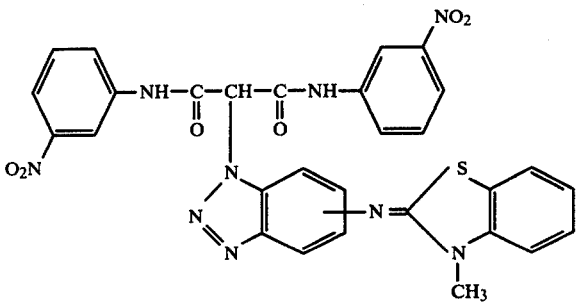
(4)
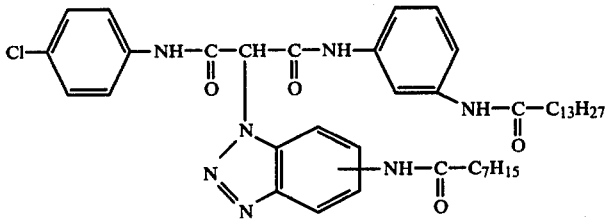
(5)
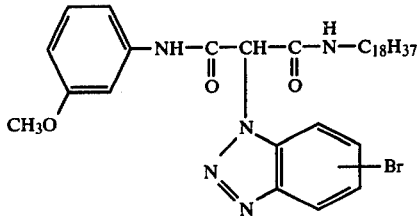
(6)
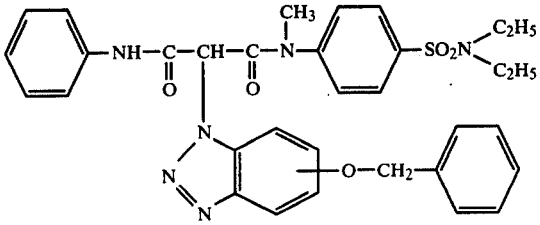

-continued
(7)
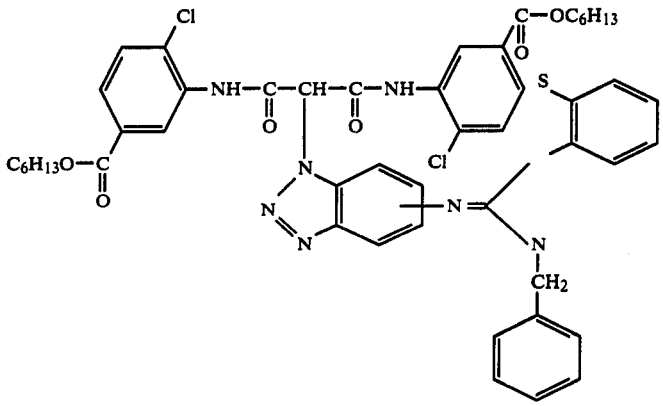
(8)
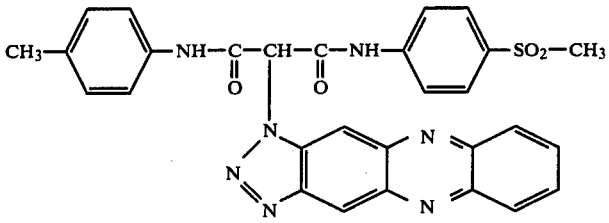
(9)
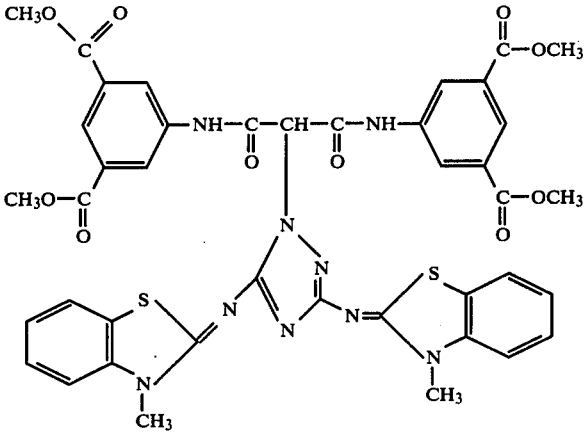
(10)
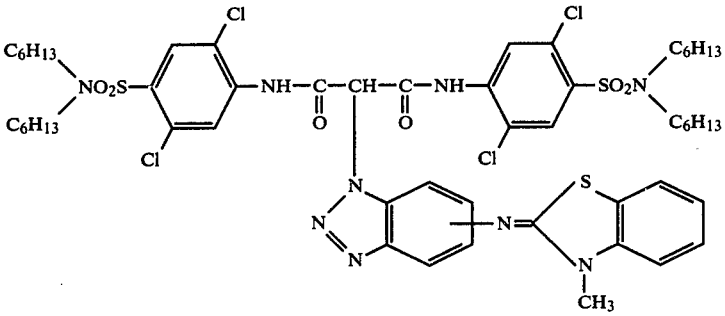
(11)
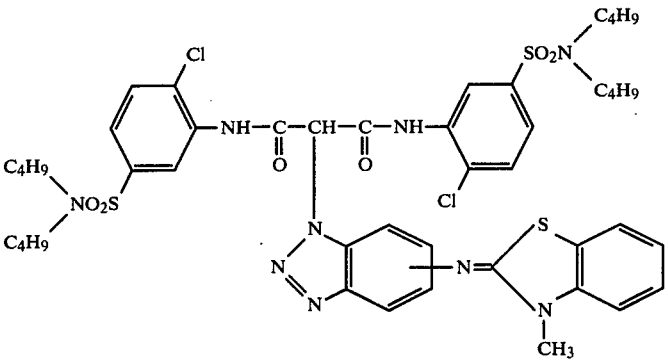

-continued

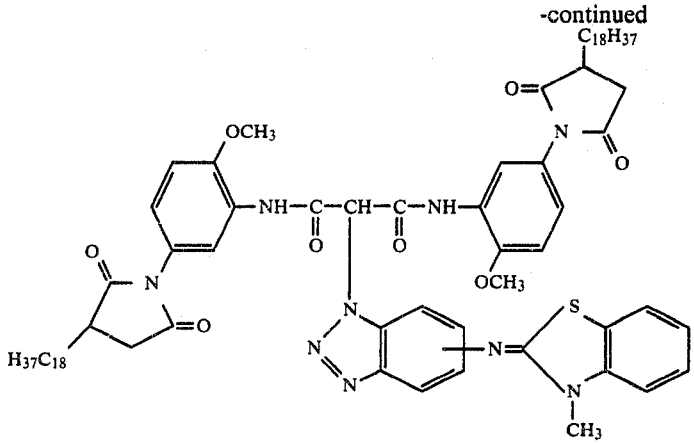

(12)

The compound represented by the general formula (I) can be easily prepared by a method including halogenation of the active methylene group of a compound represented by the general formula (III):

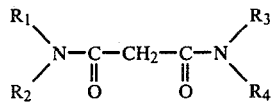

(III)

wherein $R_1$, $R_2$, $R_3$ and $R_4$ each has the same meaning as defined in the general formula (I), in a conventional manner and reacting it with a compound of the formula XH wherein X has the same meaning as defined in the general formula (I) in the presence of a base (see, e.g., U.S. Pat. No. 3,990,896). The compound represented by the general formula (III) used as a starting material described above can be prepared according to the method described in British Pat. No. 1,204,680.

Typical synthesis examples of the compounds of the present invention are illustrated by the following examples. Other compounds can also be prepared in the same manner as in the following examples. Unless otherwise indicated herein, all parts, percents, ratios and the like are by weight.

SYNTHESIS EXAMPLE 1

Compound (1)

Step 1: Preparation of Malonic Acid Di-2-chloro-5-dodecyloxycarbonylanilide 170 g (0.5 mol) of 2-chloro-5-dodecyloxycarbonylaniline and 40 g (0.25 mol) of diethyl malonate were stirred in a 1 l, three-necked flask with heating at 220° C. for about 2 hours and the ethanol formed was distilled off. After completely removing the ethanol by stirring under reduced pressure (about 50 mmHg) with heating for about 10 hours, the residue was cooled to room temperature (about 20°-30° C.). The solid deposited was recrystallized from ethanol to yield 151.6 g (81%) of the desired compound having a melting point of 94° to 95° C.

Step 2: Preparation of α-Bromomalonic Acid Di-2-chloro-5-dodecyloxycarbonylanilide 6.7 g (0.009 mol) of malonic acid di-2-chloro-5-dodecyloxycarbonylanilide prepared as described above was dissolved in 170 cc of acetic acid and, to the solution under heating at 45° C. with stirring, a solution containing 1.6 g (0.01 mol) of bromine dissolved in 30 ml of acetic acid was added dropwise over a period of about 30 minutes. The reaction solution was poured into 200 cc of ice water and the solid deposited was collected by filtration. The solid was recrystallized from acetonitrile to yield 6.8 g (92%) of the desired compound.

Step 3: Preparation of Compound (1)

30 g (0.036 mol) of α-bromomalonic acid di-2-chloro-5-dodecyloxycarbonylanilide prepared as described above and 15.3 g (0.054 mol) of 5-(3-methyl-2-benzothiazolinyliden)aminobenzotriazole were suspended in 300 ml of tetrahydrofuran (THF) and with stirring at room temperature 7.3 g (0.072 mol) of triethylamine was added dropwise thereto. After stirring for about 5 hours, 500 ml of water and 200 ml of chloroform were added and 20 ml of concentrated hydrochloric acid (about 36 wt%) was added with stirring. The solid deposited was collected by filtration and the filtrate was washed with 2N hydrochloric acid and then twice with water and dried. The solvent was removed under reduced pressure and the residue was recrystallized from ethanol to yield 30.3 g (82%) of Compound (1) having a melting point of 118° to 123° C.

SYNTHESIS EXAMPLE 2

Compound (2)

Step 1: Preparation of Malonic Acid Di-4-ethoxycarbonylanilide

Using 330 g (2.0 mol) of ethyl p-aminobenzoate and 16 g (1.0 mol) of diethyl malonate, the desired compound was obtained in the same manner as described in Synthesis Example 1. By recrystallization from ethanol, 338.6 g (85%) of the desired compound having a melting point of 220° to 221° C. was obtained.

Step 2: Preparation of α-Bromomalonic Acid Di-4-ethoxycarbonylanilide

Using 4.0 g (0.01 mol) of malonic acid di-4-ethoxycarbonylanilide prepared as described above and 1.6 g (0.01 mol) of bromine, the desired compound was obtained in the same manner as described in Synthesis Example 1. By recrystallization from acetonitrile, 4.4 g (93%) of the desired compound was obtained.

Step 3: Preparation of Compound (2)

4.8 g (0.01 mol) of α-bromomalonic acid di-4-ethoxycarbonylanilide prepared as described above and 4.3 g (0.015 mol) of 5-(3-methyl-2-benzothiazolinyliden-)aminobenzotriazole were suspended in 200 ml of THF and 2.0 g (0.02 mol) of triethylamine was added thereto followed by treatment in the same manner as described in Synthesis Example 1 to yield the desired compound. By recrystallization from acetonitrile, 6.6 g (97%) of Compound (2) having a melting point of 245° C. (decomposition) was obtained.

SYNTHESIS EXAMPLE 3

Compound (3)

Step 1: Preparation of Malonic Acid Di-3-nitroanilide

Using 138 g (1.0 mol) of m-nitroaniline and 80 g (0.5 mol) of diethyl malonate, the desired compound was obtained in the same manner as described in Synthesis Example 1. By recrystallization from acetonitrile, 148.0 g (86%) of the desired compound having a melting point of 199° to 200° C. was obtained.

Step 2: Preparation of α-Bromomalonic Acid Di-3-nitroanilide

Using 34.4 g (0.1 mol) of malonic acid di-3-nitroanilide prepared as described above and 16 g (0.1 mol) of bromine, the desired compound was obtained in the same manner as described in Synthesis Example 1. By recrystallization from acetonitrile, 38 g (90%) of the compound was obtained.

Step 3: Preparation of Compound (3)

17 g (0.04 mol) of α-bromomalonic acid di-3-nitroanilide prepared as described above and 16.9 g (0.06 mol) of 5-(3-methyl-2-benzothiazolinyliden)aminobenzotriazole were treated with triethylamine in THF in the same manner as described in Synthesis Example 1 to yield Compound (3). By recrystallization from acetonitrile, 20.5 g (82.5%) of Compound (3) having a melting point of 219° to 222° C. was obtained.

The novel DIR coupler of the present invention has a very rapid reaction rate with the oxidation product of a developing agent, and hence, exerts sufficient effects even if it is used in small amounts. Although the yellow dye formed from the DIR coupler of the present invention upon color development has an absorption coefficient which is nearly equal that formed from a conventional yellow coupler, the density of the dye formed therefrom is very pale since the amount of the DIR coupler used is small. It can, therefore, be used without fear in a layer such as a green-sensitive layer or a red-sensitive layer containing a coupler which forms a dye having a color different from that of the dye formed from the compound of the present invention. That is, the coupler of the present invention can be used simultaneously in each of three layers in a color photographic film, which is extremely advantageous from the view of cost and emulsion design. Furthermore, using the DIR coupler of the present invention, improvements in graininess particularly in the low density areas and large interlayer color correction effects are achieved.

The DIR coupler of the present invention can be used by incorporating it either into a photographic emulsion layer or into a developer solution. In order to render the DIR coupler of the present invention diffusion resistant in a photographic emulsion layer, any known ballast group can be introduced into the coupler molecule. Examples of the ballast groups are described in many patent specifications, such as U.S. Pat. No. 2,920,961, Japanese Patent Application (OPI) Nos. 123034/1974 and 19435/1957 (corresponding to U.S. Pat. Nos. 3,926,634 and 3,891,445, respectively), etc.

The DIR coupler of the present invention can be introduced into a photographic layer using any known dispersing method. The DIR coupler of the present invention can be used individually or as a combination of two or more thereof. Further, the DIR coupler of the present invention can be incorporated either into a photographic emulsion layer as a dispersion containing another coupler(s) together therewith or into a photographic subsidiary layer such as an intermediate layer as a dispersion thereof.

The DIR coupler of the present invention is used in a ratio of 0.01 to 100 mol%, preferably 0.1 to 30 mol%, to the coupler(s) other than the DIR coupler in each light-sensitive layer, such as a yellow coupler in a blue-sensitive layer, a magenta coupler in a green-sensitive layer or a cyan coupler in a red-sensitive layer of a color light-sensitive material.

Examples of dye forming couplers which can be used together with the photographic coupler of the present invention are described in the following. The dye forming coupler can be either a four-equivalent coupler or a two-equivalent coupler. Also, a dye forming coupler can be a colored coupler for color correction or a DIR coupler other than that of the present invention.

A known open-chain ketomethylene type coupler can be used as a yellow color coupler. Of these couplers a benzoylacetanilide type compound and a pivaloylacetanilide type compound are advantageous. Specific examples of yellow color couplers usable are described in U.S. Pat. Nos. 2,875,057, 3,265,506, 3,341,331, 3,369,895, 3,408,194, 3,551,155, 3,582,322 and 3,725,072, German Patent Publication No. 1,547,868, German Patent Application (OLS) Nos. 2,057,941, 2,162,899, 2,213,461, 2,219,917, 2,261,361 and 2,263,875, etc.

A pyrazolone type compound, an indazolone type compound, a cyanoacetyl type compound, and the like can be used as a magenta color coupler. Of these couplers a pyrazolone type compound is particularly advantageous. Specific examples of magenta color couplers usable are described in U.S. Pat. Nos. 2,439,098, 2,600,788, 2,983,608, 3,311,476, 3,419,391, 3,519,429, 3,558,319, 3,582,322 and 3,615,506, British Patent No. 956,261, German Pat. No. 1,810,464, German Patent Application (OLS) Nos. 2,408,665, 2,418,959 and 2,424,467, Japanese Patent Publication No. 2016/1969, etc.

A phenol derivative, a naphthol derivative, and the like can be used as a cyan color coupler. Specific examples of cyan color couplers are described in U.S. Pat. Nos. 2,369,924, 2,434,272, 2,474,293, 2,600,788, 2,698,794, 2,706,684, 2,895,826, 3,034,892, 3,214,437, 3,253,924, 3,311,476, 3,386,830, 3,458,315, 3,560,212, 3,582,322, 3,483,971 and 3,591,383, German Patent Application (OLS) Nos. 2,163,811 and 2,414,006, Japanese Patent Publication Nos. 6031/1965 and 28836/1970, etc.

The compounds described, for example, in Japanese Patent Publication No. 2016/1969, U.S. Pat. Nos. 2,434,272, 3,476,560 and 3,476,564, German Patent Application (OLS) No. 2,418,959 (as magenta color forming colored couplers), Japanese Patent Publication Nos. 22335/1963, 20591/1966, 11304/1967 and 32461/1969, U.S. Pat. Nos. 3,034,892, and 3,386,830 (as cyan color forming colored couplers) can be used as a colored coupler.

The compounds described, for example, in U.S. Pat. Nos. 3,148,062, 3,214,437, 3,227,554, 3,253,924, 3,617,291, 3,622,328, 3,639,417, 3,701,783, 3,705,201, 3,770,436 and 3,790,384, Japanese Patent Publication No. 28836/1970, German Patent Application (OLS) Nos. 2,414,006 and 2,417,914, etc., can be used as a DIR coupler other than that of the present invention.

Also, two or more of above-described dye-forming couplers, the DIR coupler of this invention and the like can be incorporated in the same layer or the same compound can be incorporated in two or more layers in order to fulfill the characteristics required in a light-sensitive material.

In order to incorporate the DIR coupler and/or the dye forming coupler into an emulsion layer, known methods, for example, the method described in U.S. Pat. No. 2,322,027, can be used. That is, the coupler is dissolved in an organic solvent having a boiling point higher than about 180° C., for example, an alkyl ester of phthalic acid (such as dibutyl phthalate, dioctyl phthalate, etc.), an ester of trimellitic acid (such as tritert-octyl trimelitate, etc.), an ester of phosphoric acid (such as diphenyl phosphate, triphenyl phosphate, tricresyl phosphate, dioctyl butyl phosphate, etc.), an ester of citric acid (such as tributyl acetyl citrate, etc.), an alkylamide (such as N,N-diethyl laurylamide, etc.), and the like, or in an organic solvent having a boiling point of about 30° to about 150° C., for example, a lower alkyl acetate (such as ethyl acetate, butyl acetate, etc.), ethyl propionate, secondary butyl alcohol, methyl isobutyl ketone, β-ethoxyethyl acetate, methyl Cellosolve acetate, and the like, and then the solution is dispersed in a hydrophilic colloid. A mixture of the high boiling organic solvent and the low boiling organic solvent described above can be used, if desired.

A coupler having an acid group such as a carboxylic acid or a sulfuric acid group can be incorporated in a hydrophilic colloid as an aqueous alkaline solution thereof.

These conventional dye forming couplers are generally used in a range from about $2\times10^{-3}$ to about $5\times10^{-1}$ mol, preferably from $1\times10^{-2}$ to $5\times10^{-1}$ mol, per mol of silver in an emulsion layer.

When a color light-sensitive material is processed in the presence of the DIR coupler of the present invention, the color processing essentially comprises a color development, a bleaching and a fixing step. Each step can be carried out individually. Two or more of these steps may be carried out in a single step by using a processing solution with two or more functions, such as a monobath bleach-fixing solution. Each of the processing steps can be divided into two or more sub-steps, if desired, and it is also possible to employ a combination of processings that comprises a color development, a first fixing and a bleach-fixing. In addition to the above described steps, a color processing can comprise steps such as pre-hardening, neutralizing, first development (black-and-white development), stabilizing and washing, depending on the need. The processing temperature can be varied depending on the kind of light-sensitive material to be processed or the type of processing. Color processing can be carried out at a temperature below about 18° C., but in most cases it is conducted at a temperature above about 18° C., particularly 20° to 60° C. Recently, color processings have often been carried out at a temperature of from about 30° to about 60° C. The processing steps can be conducted at the same temperature or at different temperatures.

A color developer solution is an aqueous alkaline solution containing a developing agent and having a pH greater than about 8, preferably between 9 and 12. The developing agent is a compound which has a primary amino group on an aromatic ring and which is capable of developing exposed silver halide or a precursor of such a compound. Preferred examples of developing agents are, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline, and the salts thereof (for example, sulfates, hydrochlorides, sulfites, p-toluenesulfonates, etc.). Other examples of developing agents are described, for example, in U.S. Pat. Nos. 2,193,015 and 2,592,364, Japanese Patent Application (OPI) 64933/1973, and L. F. A. Mason, *Photographic Processing Chemistry*, pp. 226–229, Focal Press, London (1966). The above-described compounds can be used together with 3-pyrazolidones, if desired.

If desired, various additives can be added to the color developer solution. Examples of such additives include alkaline agents (e.g., hydroxides, carbonates and phosphates of alkali metals or ammonia), pH adjusting agents or buffers (e.g., weak acids or bases, such as acetic acid and boric acid, or the salts thereof), development promoters (e.g., compounds described in U.S. Pat. Nos. 2,648,604, 3,671,247, 2,533,990, 2,577,127 and 2,950,970, British Pat. Nos. 1,020,033 and 1,020,032, U.S. Pat. No. 3,068,097, etc.), anti-fogging agents (e.g., alkali metal bromides and alkali metal iodides, nitrobenzoimidazoles, such as those described in U.S. Pat. No. 2,496,940 and 2,656,271, mercaptobenzimidazole, 5-methylbenzotriazole, 1-phenyl-5-mercaptotetrazole, the anti-fogging agents described in U.S. Pat. Nos. 3,113,864, 3,342,596, 3,295,976, 3,615,522 and 3,597,199, British Pat. No. 972,211, Japanese Patent Publication No. 41675/1971, and *Kagaku Shashin Binran* (*Handbook of Scientific Photography*), Vol. II, pp. 29–47, stain or sludge preventing agents (e.g., those described in U.S. Pat. Nos. 3,161,513 and 3,161,514, British Pat. Nos. 1,030,442, 1,144,481, and 1,251,558), and preservatives (e.g., sulfites, bisulfites, hydroxylamine hydrochloride, formsulfites, alkanolamine-sulfite adducts, and the like).

In the course of color processing, an intensification processing can be conducted, as described in German Patent Application (OLS) No. 2,226,770, U.S. Pat. No. 3,826,652, etc.

In the case of a black-and-white development, any of the known developing agents or combinations thereof can be used. The processing solution used can contain almost the same additives as those used in color processing solutions.

The amount of the DIR coupler of the present invention used varies depending on the type of light-sensitive material and processing, but ordinarily DIR coupler of this invention can be incorporated with advantage into a light-sensitive material at a concentration of about 0.00001 mol to about 0.5 mol per mol of silver halide contained therein, and can be added to a developer solution at a concentration of about $1\times10^{-4}$ to about $1\times10^{-1}$ mol per 1,000 ml of the developer solution.

The silver halide photographic emulsions used in the present invention are those in which light-sensitive silver halides such as silver chloride, silver bromide, silver chlorobromide, silver chloroiodide, silver iodobromide and silver chloroiodobromide are dispersed in a hydrophilic high molecular weight substance (protective colloid), such as gelatin, etc., and can be prepared by various methods.

Various conventional additives for ordinary silver halide photographic emulsions such as chemical sensitizers, stabilizers, anti-fogging agents, hardeners, spectral sensitizers, surface active agents, etc., can be incorporated in the silver halide photographic emulsion used in this invention. The photographic emulsions can be coated on an appropriate photographic support using known methods.

Preferred examples of the photographic supports are a film of a synthetic polymer, such as cellulose acetate, polyethylene, polyethylene terephthalate, polycarbonate, etc., a paper coated or laminated with a baryta layer or an α-olefin polymer (for example, polyethylene, polypropylene, a copolymer of ethylene and butene, etc.), and the like.

The DIR coupler of the present invention can be used in various kinds of silver halide photographic light-sensitive materials. For example, the DIR coupler of this invention can be employed in silver halide photographic light-sensitive materials used for various purposes such as conventional black-and-white light-sensitive materials, lithographic black-and-white light-sensitive materials, light-sensitive materials for X-ray or electron beam recording, black-and-white light-sensitive materials having high resolving power, conventional color light-sensitive materials, color light-sensitive materials for X-ray recording, light-sensitive materials for the color diffusion transfer process, and the like.

According to one embodiment of the present invention, a multilayer color light-sensitive material can comprise a support having thereon a blue-sensitive emulsion layer unit comprising at least one silver halide emulsion layer which is mainly sensitive to blue light (wavelength region of about 500 nm or below) and contains a yellow color coupler capable of forming a yellow dye upon coupling with an oxidation product of an aromatic primary amine developing agent, a green-sensitive emulsion layer unit comprising at least one silver halide emulsion layer which is mainly sensitive to green light (wavelength region of about 500 to about 600 nm) and contains a magenta color coupler capable of forming a magenta dye upon coupling with an oxidation product of an aromatic primary amine developing agent and a red-sensitive emulsion layer unit comprising at least one silver halide emulsion layer which is sensitive to red light (wavelength region of about 590 nm or more) and contains a cyan color coupler capable of forming a cyan dye upon coupling with an oxidation product of an aromatic primary amine developing agent, and optionally a photographic subsidiary layer such as an intermediate layer(s) and the DIR coupler of the present invention can be incorporated into at least one of the above-described emulsion layers or intermediate layers.

In the above-described embodiment, each emulsion layer which comprises the blue-sensitive emulsion layer unit, the green-sensitive emulsion layer unit and red-sensitive emulsion layer unit can be positioned in various orders depending on the purpose of the use of the light-sensitive material. For example, when each emulsion layer unit comprises a single emulsion layer, a red-sensitive emulsion layer, a green-sensitive emulsion layer and a blue-sensitive emulsion layer are positioned in this order from a support or these layers are interchanged into another order. Also, when an emulsion layer unit comprises two or more emulsion layers, these emulsion layers are positioned either contiguous to each other or separated with an emulsion layer of another emulsion layer unit.

A useful multilayer color light-sensitive material can also comprise a support having thereon a red-sensitive silver halide photographic emulsion layer unit containing a diffusion resistant uncolored cyan coupler and a diffusion resistant colored cyan coupler, both of which can provide cyan image by color development, a green-sensitive silver halide photographic emulsion layer unit containing a diffusion resistant uncolored magenta coupler and a diffusion resistant colored magenta coupler, both of which can provide magenta image, and a blue-sensitive silver halide photographic emulsion layer unit containing a diffusion resistant uncolored yellow coupler, which can provide yellow image, and the DIR coupler of the present invention can be incorporated into at least one layer of the red-sensitive emulsion layer unit, the green-sensitive emulsion layer unit, the blue-sensitive emulsion layer unit or an intermediate layer present.

The DIR coupler of the present invention has such high activity that it rapidly reacts with the oxidation product of a developing agent to release a development inhibitor, so that even a small amount thereof exhibits excellent development inhibiting effects which result in a control of image tone, a reduced graininess of image, an improved sharpness of image and an improved color reproducibility. Further, since the DIR coupler of the present invention is stable when incorporated in a light-sensitive emulsion layer and does not adversely affect the durability of the light-sensitive material, it can be used without fear. Furthermore, the DIR coupler of the present invention can be prepared very easily as described in Synthesis Examples hereinbefore.

The present invention will be further illustrated by reference to the following examples, but the present invention should not be construed as limited to the following examples.

EXAMPLE 1

Sample 101: On a transparent cellulose triacetate film support were coated the following first layer to fourth layer in this order and dried to prepare the sample. The composition and method for preparation of the coating solution used for each layer was as follows.

First Layer: Red-Sensitive Emulsion Layer

One kg of a high speed silver iodobromide emulsion (silver content: 0.6 mol, iodide content: 6mol%) prepared in a conventional manner was spectrally sensitized using $4\times10^{-5}$ mol of Sensitizing Dye I and $1\times10^{-5}$ of Sensitizing Dye II per mol of silver, respectively. 550 g of Dispersion I prepared by dissolving 100 g of Coupler A (described below) into 100 cc of tricresyl phosphate and 200 cc of ethyl acetate, and then dispersing the resulting solution into 1 kg of a 10% aqueous gelatin solution using 4 g of sodium nonylbenzenesulfonate (surface active agent) was added to the spectrally sensitized silver iodobromide emulsion and stirred. To the mixture an aqueous solution of 2 g of sodium 2,4-dichloro-6-hydroxytriazine was added as a hardener. The thus prepared coating solution was coated on a transparent cellulose triacetate film support at a silver coated amount of 1.5 g/m$^2$.

Second Layer: Intermediate Layer 50 g of 2,5-di-tert-octylhydroquinone was dissolved in 100 cc of tricresyl phosphate and dispersed in 1 kg of a 10% aqueous gelatin solution in the same manner as described in Dispersion I. 250 g of the thus prepared dispersion and an aqueous solution of 2 g of sodium 2,4-dichloro-6-hydroxytriazine were added to 1 kg of a 10% aqueous gelatin solution and stirred. The coating solution was coated at a dry thickness of 1.5 μ.

Third Layer: Green-Sensitive Emulsion Layer 1 g of a high speed silver iodobromide emulsion (same as used in First Layer) was spectrally sensitized using $3\times10^{-5}$ mol of Sensitizing Dye III and $1\times10^{-5}$ mol of Sensitizing Dye IV per mol of silver, respectively. Using 100 g of Coupler B, Dispersion II was prepared in the same manner as described in Dispersion I. 700 g of Dispersion II was added to the spectrally sensitized silver iodobromide emulsion and an aqueous solution of 2 g of sodium 2,4-dichloro-6-hydroxytriazine was added thereto with stirring.

Fourth Layer: Protective Layer

To 1 kg of a 10% aqueous gelatin solution was added 2 g of sodium 2,4-dichloro-6-hydroxytriazine. The solution was coated at a dry thickness of 1.5 μ. Samples 102 to 105: Samples 102 to 105 were prepared in the same manner as Sample 101 except that the optimum amount of DIR coupler (as shown in Table 1 below) was additionally incorporated into the coupler solvent in Dispersion I of Sample 101.

The compounds used for the preparation of the abovedescribed samples were:

Sensitizing Dye I: Pyridinium salt of anhydro-5,5'-dichloro-3,3'-di-(3-sulfopropyl)-9-ethylthiacarbocyanine hydroxide Sensitizing Dye II: Triethylamine salt of anhydro-9-ethyl-3,3'-di(3-sulfopropyl)-4,5,4',5'-dibenzothiacarbocyanine hydroxide Sensitizing Dye III: Sodium salt of anhydro-9-ethyl-5,5'-dichloro-3,3'-di-(3-sulfopropyl)oxacarbocyanine Sensitizing Dye IV: Sodium salt of anhydro-5,6,5',6'-tetrachloro-1,1'-diethyl-3,3'-di-[2-(3-sulfopropoxy)ethoxyethyl]imidazolocarbocyanine hydroxide Coupler A: 1-Hydroxy-N-[γ-(2,4-di-tert-amylphenoxy)propyl]-2-naphthamide Coupler B: 1-(2,4,6-Trichlorophenyl)-3-[3-(2,4-di-tert-amylphenoxyacetamido)benzamido]-5-pyrazolone (4-equivalent coupler)

Comparison DIR Coupler D-1: α-(1'-Phenyltetrazol-5'-ylthio)-α-benzoyl-2-methoxy-5-(tetradecyloxycarbonyl)acetanilide Comparison DIR Coupler D-2; α-(1'-Phenyltetrazol-5'-ylthio)-αpivaloyl-2-chloro-5-[α-(2,4-di-tert-amylphenoxy)butyramido]-acetanilide Samples 101 to 105 were exposed stepwise using red light and then exposed uniformly using green light, and subjected to the following processing steps at 38° C. In addition, these samples were line image exposed to soft X-rays through a slit with a 4 mm width and a slit with a 10 μm width and subjected to the same processing as above.

| | |
|---|---|
| 1. Color Development | 3 min and 15 sec |
| 2. Bleaching | 6 min and 30 sec |
| 3. Washing | 3 min and 15 sec |
| 4. Fixing | 6 min and 30 sec |
| 5. Washing | 3 min and 15 sec |
| 6. Stabilizing | 3 min and 15 sec |

The processing solutions used in above steps had the following compositions:

| | |
|---|---|
| Color Developer Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 l |
| Bleaching Solution | |
| Ammonium Bromide | 160.0 g |
| Ammonia (28% aq. soln.) | 25.0 ml |
| Sodium Ferric Ethylenediamine-tetraacetate | 130 g |
| Acetic Acid (glacial) | 14 ml |
| Water to make | 1 l |
| Fixing Solution | |
| Sodium Tetrapolyphosphate | 2.0 g |
| Sodium Sulfite | 4.0 g |
| Ammonium Thiosulfate (70% aq. soln.) | 175.0 ml |
| Sodium Bisulfite | 4.6 g |
| Water to make | 1 l |
| Stabilizing Solution | |
| Formaldehyde (40% aq. soln.) | 8.0 ml |
| Water to make | 1 l |

In the characteristic curve thus obtained, when the gradation of the curve of the red filter optical density vs. log (exposure amount) (which corresponds to the first layer) is designated $\gamma_R$ and the gradation of the curve of the green filter optical density vs. log (exposure amount) (which corresponds to the third layer) is designated $\gamma_G$, the value of $\gamma_G/\gamma_R$ is considered to be the amount of interimage effects from the first layer to the third layer ($\gamma_R$ values of the samples other than Sample 101 are substantially constant). That is, the value of $\gamma_G/\gamma_R$ is minus and larger numerical values mean larger interimage effects. The $\gamma_G/\gamma_R$ value of each sample is shown in Table 1 below.

The optical density of each sample obtained by line image exposure with soft X-rays was measured by microdensitometer tracing with red light. When the density of the line image with a 10 μ width is designated $D_1^R$ and the density of the line image with a 4 mm width is designated, $D_2^R$, the value of $(D_1^R-D_2^R)/D_1^R$ means the amount of edge effects of the sample when the sample is observed with red light. The value of $(D_1^R-D_2^R)/D_1^R$ of each sample is shown in Table 1 below.

TABLE 1

| Sample No. | DIR Material Compound | DIR Material Amount* (mol%) | $\gamma_R$ | Interimage Effects $\gamma_G/\gamma_R$ | Edge Effects $(D_1^R-D_2^R)/D_1^R$ |
|---|---|---|---|---|---|
| 101 (control) | — | — | 1.20 | 0.05 | 0.04 |
| 102 (this invention) | Compound (1) | 1.7 | 0.77 | −0.43 | 0.29 |
| 103 (this invention) | Compound (2) | 3 | 0.74 | −0.37 | 0.26 |
| 104 | Coupler | 12 | 0.80 | −0.15 | 0.13 |

TABLE 1-continued

| Sample No. | DIR Material Compound | Amount* (mol%) | $\gamma_R$ | Interimage Effects $\gamma_G/\gamma_R$ | Edge Effects $(D_1^R-D_2^R)/D_1^R$ |
|---|---|---|---|---|---|
| (comparison) 105 (comparison) | D-1 Coupler D-2 | 10 | 0.79 | −0.12 | 0.10 |

*Amount: mol% to Coupler A

The inertia sensitivities of all samples were approximately equal.

From the results described above it is apparent that Compounds (1) and (2) of the present invention provide almost the same gradation of the layer containing the compound and provide extremely large interimage effects to the adjacent layer and edge effects within the layer in comparison with the comparison DIR Couplers D-1 and D-2, even though the molar amount of Compounds (1) and (2) was ⅓ to 1/6 that of Coupler D-1 or D-2.

fects were evaluated in the same manner as described in Example 1. The larger the value of $(D_1^G-D_2^G)1D_1^G$ means greater edge effects when observed with green light. The results obtained are shown in Table 2 below.

Furthermore, each sample was exposed stepwise with white light and processed in the same manner as described in Example 1 and then the graininess of the color image thereof was measured by a conventional RMS (Root Mean Square) method using green light. The results of the RMS graininess at densities of 0.5 and 1.5 are shown in Table 2 below.

TABLE 2

| Sample No. | DIR Material Compound | Amount (mol%) | $\gamma_G$ | Inter-image Effects $(\gamma_R/\gamma_G)$ | Edge Effects $(D_1^G-D_2^G)/D_1^G$ | RMS Graininess* $D_G=0.5$ | $D_G=1.5$ |
|---|---|---|---|---|---|---|---|
| 201 (control) | — | — | 1.31 | 0.04 | 0.04 | 0.054 | 0.076 |
| 202 (this invention) | Compound (3) | 2 | 0.64 | −0.48 | 0.36 | 0.038 | 0.050 |
| 203 (comparison) | DIR Coupler D-3 | 8 | 0.66 | −0.35 | 0.21 | 0.046 | 0.062 |

Amount: mol% to Coupler B.
RMS Graininess: measured with a slit of 10 μ × 10 μ.

EXAMPLE 2

Sample 201: The sample was prepared in the same manner as Sample 101 in Example 1.

Sample 202: The sample was prepared in the same manner as Sample 201 except that Compound (3) of the present invention was further added in an amount of 2 mol% per mol of Coupler B to the coupler solvent in Dispersion II added to the third layer of Sample 201.

Sample 203: The sample was prepared in the same manner as Sample 202 except that Comparison DIR Coupler D-3 was used in an amount of 8 mol% per mol of Coupler B in place of Compound (3). Comparison DIR Coupler D-3: α-(5- or 6-Heptanamido-1-benzotriazolyl)-α-(4-octadecyloxybenzoyl)-2-ethoxyacetanilide Sample 201 to 203 were exposed stepwise using green light and then exposed uniformly using red light and processed in the same manner as described in Exaple 1. In addition, these samples were line image exposed to soft X-rays through a slit with a 4 mm width and a slit with a 10 μm width and processed in the same manner as in Example 1.

From the characteristic curve thus obtained the interimage effects were evaluated in the same manner as described in Example 1. The value of $\gamma_R/\gamma_G$ is minus and the larger the numerical value means larger interimage effects from the third layer (green-sensitive layer) to the first layer (red-sensitive layer). The $\gamma_R/\gamma_G$ value of each sample is shown in Table 2 below.

The optical density of each sample obtained by line image exposure with soft X-rays was measured by microdensitometer traces with green light. The edge ef- The smaller the numerical value in Table 2 the better the graininess.

The measurement of the graininess of the RMS method is well known in the photographic art and described in D. Zwick & B. L. Brothers Jr., RMS Granularity; "Determination of Justnoticeable Difference", *Photographic Science and Engineering,* Vol. 19, No. 4, pp. 235–238 (1975).

From the results shown in Table 2 above it is apparent that Compound (3) of the present invention provides almost the same gradation and larger interimage effects, edge effects and effects of reducing the graininess of the color image in comparison with the comparison DIR Coupler D-3 even though the molar amount of Compound (3) was ¼ that of the Comparison DIR Coupler D-3.

EXAMPLE 3

Sample 301: The sample was prepared in the same manner as Sample 101 in Example 1.

Samples 302, 303 and 304: Samples 302, 303 and 304 were prepared in the same manner as Sample 101 except that Compound (4) of the present invention in an amount of 15 mol% and 1.2 mol% per mol of Coupler B and Comparison DIR Coupler D-4 described in Japanese Patent Application (OPI) No. 122335/1974 in an amount of 10 mol% per mol of Coupler B were further added to the coupler solvent in Dispersion II added to the third layer of Sample 101, respectively.

The interimage effects, edge effects and effects of reducing the graininess of these samples were determined in the same manner as described in Example 2. The results obtained are shown in Table 3 below.

Comparison DIR Coupler D-4: α-(5- or 6-bromo-1-benzotriazolyl)-α-(4-octadecyloxybenzoyl)-2-ethoxyacetanilide

TABLE 3

| Sample No. | DIR Material Compound | DIR Material Amount (mol%) | $\gamma_G$ | Inter-image Effects ($\gamma_R/\gamma_G$) | Edge Effects $(D_1^G-D_2^G)/D_1^G$ | RMS Graininess $D_G=1.0$ |
|---|---|---|---|---|---|---|
| 301 (control) | — | — | 1.30 | 0.04 | 0.06 | 0.080 |
| 302 (this invention) | Compound (4) | 15 | 0.12 | −0.89 | 0.78 | 0.020 |
| 303 (this invention) | Compound (4) | 1.2 | 0.96 | −0.33 | 0.28 | 0.059 |
| 304 (comparison) | DIR Coupler D-4 | 15 | 0.98 | −0.26 | 0.20 | 0.075 |

The results shown in Table 3 indicate that Compound (4) of the present invention is extremely highly active and provides almost the same gradation (γ) and superior interimage effects to the adjacent layer, edge effects and effects of reducing the graininess in comparison with Comparison DIR Coupler D-4 described in Japanese Patent Application (OPI) No. 122335/1974, even though the molar amount of Compound (4) was 1/10 or less than that of Comparison DIR Coupler D-4.

EXAMPLE 4

On a cellulose triacetate film support were coated layers having the compositions set forth below to prepare a multilayer color light-sensitive material. The compounds indicated by an asterisk are the same compounds used in Example 1.

First Layer: Antihalation Layer (AHL)

A gelatin layer containing black colloidal silver

Second Layer: Intermediate Layer (ML)

A gelatin layer containing a dispersion of 2,5-ditert-octylhydroquinone.

Third layer: First Red-Sensitive Emulsion Layer ($RL_1$)

| A silver iodobromide emulsion (iodide content, 5 mol %) | silver coated amount 1.79 g/m² |
|---|---|
| Sensitizing Dye I* | $6 \times 10^{-5}$ mol per mol of silver |
| Sensitizing Dye II* | $1.5 \times 10^{-5}$ mol per mol of silver |
| Coupler A* | 0.04 mol per mol of silver |
| Coupler C-1 | 0.0015 mol per mol of silver |
| Coupler C-2 | 0.0015 mol per mol of silver |
| Compound (1) described above | 0.0006 mol per mol of silver |

Fourth Layer: Second Red-Sensitive Emulsion Layer ($RL_2$)

| A silver iodobromide emulsion (iodide content, 4 mol%) | silver coated amount, 1.4 g/m² |
|---|---|
| Sensitizing Dye I* | $3 \times 10^{-5}$ mol per mol of silver |
| Sensitizing Dye II* | $1.2 \times 10^{-5}$ mol per mol of silver |
| Coupler A* | 0.005 mol per mol of silver |
| Coupler C-1 | 0.0008 mol per mol of silver |
| Coupler C-2 | 0.0008 mol per mol of silver |
| Coupler C-3 | 0.015 mol per mol of silver |
| Compound (1) described above | 0.00006 mol per mol of silver |

Fifth Layer: Intermediate Lyaer (ML)

Same as Second Layer

Sixth Layer: First Green-Sensitive Emulsion Layer ($GL_1$)

| A silver iodobromide emulsion (iodide content, 4 mol%) | silver coated amount, 1.5 g/m² |
|---|---|
| Sensitizing Dye III* | $3 \times 10^{-5}$ mol per mol of silver |
| Sensitizing Dye IV* | $1 \times 10^{-5}$ mol per mol of silver |
| Coupler B* | 0.05 mol per mol of silver |
| Coupler M-1 | 0.008 mol per mol of silver |
| Compound (1) described above | 0.0015 mol per mol of silver |

Seventh Layer: Second Green-Sensitive Emulsion Layer ($GL_2$)

| A silver iodobromide emulsion (iodide content, 5 mol%) | silver coated amount, 1.6 g/m² |
|---|---|
| Sensitizing Dye III* | $2.5 \times 10^{-5}$ mol per mol of silver |
| Sensitizing Dye IV* | $0.8 \times 10^{-5}$ mol per mol of silver |
| Coupler B* | 0.02 mol per mol of silver |
| Coupler M-1 | 0.003 mol per mol of silver |
| Compound (1) described above | 0.0003 mol per mol of silver |

Eighth Layer: Yellow Filter Layer (YEL)

A gelatin layer containing yellow colloidal silver and a dispersion of 2,5-di-tert-octylhydroquinone Ninth Layer: First Blue-Sensitive Emulsion Layer ($BL_1$)

| A silver iodobromide emulsion (iodide content, 6 mol%) | silver coated amount, 1.5 g/m² |
|---|---|
| Coupler Y-1 | 0.25 mol per mol of silver |
| Compound (1) described above | 0.001 mol per mol of silver |

Tenth Layer: Second Blue-Sensitive Emulsion Layer ($BL_2$)

| A silver iodobromide emulsion (iodide content, 6 mol%) | silver coated amount, 1.1 g/m² |
|---|---|
| Coupler Y-1 | 0.06 mol per mol of silver |

Eleventh Layer: Protective Layer (PL)

A gelatin layer containing an ultra-fine grain silver iodobromide emulsion (containing 0.06 mol of silver per kg of emulsion, having an iodide content of 1.4 mol%, and having an average grain size of 0.03 μ), and polymethyl methacrylate particles (having a diameter of about 1.5 μ) silver coated amount, 2.3 g/m²

A gelatin hardener and a surface active agent as described in Example 1 were incorporated into each of the layers in addition to the above-described components.

The thus prepared sample was designated Sample 401. Samples 402 and 403 were prepared in the same manner as Sample 401 except that the above-described Comparision DIR Couplers D-1 and D-4 were used in place of Compound (1) of Sample 401, respectively. The amounts of the DIR Couplers used were as follows.

| | | | |
|---|---|---|---|
| Sample 401 | | | |
| $RL_1$ | Compound (1) | 0.0006 | mol per mol of silver |
| $RL_2$ | " | 0.00006 | " |
| $GL_1$ | " | 0.0015 | " |
| $GL_2$ | " | 0.0003 | " |
| $BL_1$ | " | 0.001 | " |
| Sample 402 | | | |
| $RL_1$ | Comparison DIR Coupler D-1 | 0.0025 | mol per mol of silver |
| $RL_2$ | " | 0.00025 | " |
| $GL_1$ | " | 0.008 | " |
| $GL_2$ | " | 0.002 | " |
| $BL_1$ | " | 0.007 | " |
| Sample 403 | | | |
| $RL_1$ | Comparison DIR Coupler D-4 | 0.01 | mol per mol of silver |
| $RL_2$ | " | 0.001 | " |
| $GL_1$ | " | 0.028 | " |
| $GL_2$ | " | 0.007 | " |
| $BL_1$ | " | 0.02 | " |

The couplers used for the preparation of these samples were as follows.

Coupler C-1: 1-Hydroxy-4-[2-(2-hexyldecyloxycarbonyl)phenylazo]-2-[N-(1-naphthyl)]naphthamide Coupler C-2: 1-Hydroxy-4-[4-(ethyloxycarbonyl)-phenylazo]-2-(N-dodecyl)naphthamide Coupler C-3: 1-Hydroxy-4-iodo-2-(N-dodecyl)naphthamide Coupler M-1: 1-(2,4,6-Trichlorophenyl)-3-hexadecanamido-4-(4-hydroxyphenyl)azo-5-pyrazolone Coupler Y-1: α-(2,4-Dioxo-5,5-dimethyloxazolidinyl)-α-pivaloyl-2-chloro-5-[α-(2,4-di-tert-amylphenoxy)butyramido]acetanilide The samples thus prepared were exposed stepwise with white light and subjected to sensitometry as described in Example 1. The sensitivity and gradation in each emulsion layer of Samples 401 to 403 are approximately equal.

The evaluations of edge effects and RMS graininess of these samples were carried out in the same manner as described in Example 1 and Example 2. The results are shown in Table 4 below.

Further, each sample was exposed to white light and processed in the same manner as described in Example 1. The residual silver contained in each sample was determined by fluorescent X-ray analysis. The results are shown in Table 4 below.

TABLE 4

| Sample No. | Measured Light | Edge Effects $(D_1-D_2)/D_1$ | RMS Graininess D=0.5 | RMS Graininess D=1.5 | Interimage Effects $\Gamma_R/\Gamma_G$ | Interimage Effects $\Gamma_R/\Gamma_G$ | Amount of Residual Silver (μg/cm²) |
|---|---|---|---|---|---|---|---|
| 401 (this invention) | Blue light | 0.33 | 0.065 | 0.054 | | | |
| | Green light | 0.29 | 0.040 | 0.035 | −0.39 | | 0.2 |
| | Red light | 0.30 | 0.042 | 0.036 | | −0.36 | |
| 402 (comparison) | Blue light | 0.19 | 0.070 | 0.058 | | | |
| | Green light | 0.15 | 0.049 | 0.036 | −0.19 | | 7.1 |
| | Red light | 0.17 | 0.050 | 0.038 | | −0.19 | |
| 403 (comparison | Blue light | 0.27 | 0.077 | 0.069 | | | |
| | Green light | 0.22 | 0.057 | 0.043 | −0.31 | | 0.1 |
| | Red light | 0.25 | 0.055 | 0.044 | | −0.29 | |

D=0.5 and 1.5 in RMS Grainless mean a density of mask density + 0.5 and 1.5, respectively.

It is apparent from the results shown above that Sample 401 which contains Compound (1) of the present invention shows greater edge effects, effects of reducing the graininess and interimage effects as compared with Samples 402 and 403 which contain Comparison DIR Couplers D-1 and D-4, respectively, even though the amount of Compound (1) was smaller than that of Comparison DIR Coupler D-1 or D-4. Further, according to the present invention, the amount of residual silver present is extremely small and thus color turbidity due to insufficient bleaching of silver was prevented.

Furthermore, these samples were cut into films of 35 mm size and photographed to form negative films. Color prints were prepared by printing the negative films using an enlarging technique. The color print obtained using Sample 401 had the finest graininess and the sharpest image and showed clear colors, particularly clearly reproduced green and red colors.

These results indicate that Compound (1) had excellent activity in terms of improving graininess, sharpness and color reproduction.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide emulsion layer containing a development inhibitor releasing photographic coupler represented by the following general formula (I):

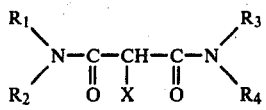

(I)

wherein $R_1$, $R_2$, $R_3$ and $R_4$, which may be the same or different, each represents a hydrogen atom, an aliphatic residue, an aromatic residue or a heterocyclic residue; and X represents a triazole ring which is released upon reaction of the coupler with an oxidation product of an aromatic primary developing agent and which exhibits development inhibiting effects, with the triazole ring being connected to the coupling position of the coupler through the nitrogen atom at the 1-position of the ring.

2. The photographic light-sensitive material as claimed in claim 1, wherein said aliphatic residue is an aliphatic residue having 1 to 25 carbon atoms.

3. The photographic light-sensitive material as claimed in claim 1, wherein said aliphatic residue is substituted with one or more of an alkoxy group, a halogen atom, a hydroxy group, a carboxy group, a sulfo group, a heterocyclic group or an aryl group.

4. The photographic light-sensitive material as claimed in claim 1, wherein said aromatic residue is an aromatic residue having 6 to 35 carbon atoms.

5. The photographic light-sensitive material as claimed in claim 1, wherein said aromatic residue is a phenyl group substituted with one or more of a halogen atom, a nitro group, a cyano group, thiocyano groups, a hydroxy group, an alkoxy group, an aryloxy group, an alkyl group, an alkenyl group, an aryl group, an amino group, a carboxy group, an acyl group, an alkoxycarbonyl group, an aryloxycarbonyl group, a carbamoyl group, an acylamino group, a sulfo group, an alkylsulfonyl group, an arylsulfonyl group, and alkoxysulfonyl group, an aryloxysulfonyl group, a sulfamoyl group or a sulfonamino group.

6. The photographic light-sensitive material as claimed in claim 1, wherein said heterocyclic residue is a 5- or 6-membered ring containing one or more of a nitrogen atom, an oxygen atom or a sulfur atom and 1 to 25 carbon atoms.

7. The photographic light-sensitive material as claimed in claim 1, wherein said heterocyclic residue is substituted with one or more of an alkyl group, an alkoxy group, a halogen atom or an alkoxycarbonyl group.

8. The photographic light-sensitive material as claimed in claim 1, wherein X represents a benzotriazolyl group.

9. The photographic light-sensitive material as claimed in claim 1, wherein X represents a 1,2,4-triazolyl group.

10. The photographic light-sensitive material as claimed in claim 1, wherein $R_1$ and $R_3$ each represents a hydrogen atom and $R_2$ and $R_4$ each represents an aromatic residue.

11. The photographic light-sensitive material as claimed in claim 1, wherein said photographic light-sensitive material comprises a support having thereon a blue-sensitive silver halide emulsion layer unit, a green-sensitive silver halide emulsion layer unit and a red-sensitive silver halide emulsion layer unit and said photographic coupler represented by the general formula (I) is present in at least one of said silver halide emulsion layer units.

12. An aqueous alkaline developing solution containing an aromatic primary amino developing agent and a development inhibitor releasing photographic coupler represented by the following general formula (I):

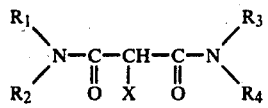

(I)

wherein $R_1$, $R_2$, $R_3$ and $R_4$, which may be the same or different, each represents a hydrogen atom, an aliphatic residue, an aromatic residue or a heterocyclic residue; and X represents a triazole ring which is released upon reaction of the coupler with an oxidation product of an aromatic primary developing agent and which exhibits development inhibiting effects, with the triazole ring being connected to the coupling position of the coupler through the nitrogen atom at the 1-position of the ring.

13. A method of forming images comprising developing an imagewise exposed photographic light-sensitive material comprising a support having thereon at least one silver halide emulsion layer in the presence of a development inhibitor releasing photographic coupler represented by the following general formula (I):

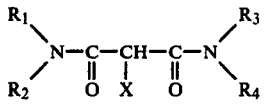

(I)

wherein $R_1$, $R_2$, $R_3$ and $R_4$, which may be the same or different, each represents a hydrogen atom, an aliphatic residue, an aromatic residue or a heterocyclic residue; and X represents a triazole ring which is released upon reaction of the coupler with an oxidation product of an aromatic primary amine developing agent and which exhibits development inhibiting effects, with the triazole ring being connected to the coupling position of the coupler through the nitrogen atom at the 1-position of the ring, the said exposed material being developed with an aromatic primary amino color developing agent and the color developing agent, after being oxidized, coupling with the said coupler to form a dye image and to release a development inhibitor wherein the coupler initially present in either the said silver halide emulsion or a color developing solution.

14. The photographic light-sensitive material as claimed in claim 1, wherein X represents a 1,2,3-triazolyl group.

15. The photographic light-sensitive material as claimed in claim 14, wherein said 1,2,3-triazolyl group is substituted with a halogen atom.

16. The developing solution of claim 12 wherein X represents a 1,2,3-triazolyl group.

17. The developing solution of claim 16, wherein said 1,2,3-triazolyl group is substituted with a halogen atom.

18. The developing solution of claim 12, wherein X represents a 1,2,4-triazolyl group.

19. The method of claim 13, wherein X represents a 1,2,3-triazolyl group.

20. The method of forming images as claimed in claim 19, wherein said 1,2,3-triazolyl group is substituted with a halogen atom.

21. The method of claim 13, wherein X represents a 1,2,4-triazolyl group.

22. The photographic light sensitive material of claim 1, wherein X is a benzotriazole group substituted with one or more of an alkyl group, an alkoxy group, a halogen atom, an alkylamido group or an aralkoxy group.

23. The photographic light sensitive material of claim 22, wherein for substituents on X: said alkyl group has 1-10 carbon atoms, said alkoxy group has 1-15 carbon atoms, said halogen is chlorine or bromine, said alkylamido group has 1-15 carbon atoms and said aralkoxy group has 7 or 8 total carbon atoms.

24. The photographic developing solution of claim 12, wherein X is a benzotriazole group substituted with one or more of an alkyl group, an alkoxy group, a halogen atom, an alkylamido group or an aralkoxy group.

25. The photographic developing solution of claim 24, wherein for said substituents on X: said alkyl group has 1-10 carbon atoms, said alkoxy group has 1-15 carbon atoms, said halogen is chlorine or bromine, said alkylamido group has 1-15 carbon atoms and said aralkoxy group has 7 or 8 total carbon atoms.

26. The method of forming images of claim 13, wherein X is a benzotriazole group substituted with one or more of an alkyl group, an alkoxy group, a halogen atom, an alkylamido group or an aralkoxy group.

27. The method of forming images of claim 26, wherein for said substituents on X: said alkyl group has 1-10 carbon atoms, said alkoxy group has 1–15 carbon atoms, said halogen is chlorine or bromine, said alkylamido group has 1–15 carbon atoms and said aralkoxy group has 7 or 8 total carbon atoms.

28. The photographic light sensitive material of claim 1, wherein X is a quinoxalino[2,3-f]benzotriazolyl group.

29. The photographic developing solution of claim 12, wherein X is a quinoxalino[2,3-f]benzotriazolyl group.

30. The method of forming images of claim 13, wherein X is a quinoxalino[2,3-f]benzotriazolyl group.

* * * * *